United States Patent [19]

Ahlstone

[11] Patent Number: 4,583,569

[45] Date of Patent: Apr. 22, 1986

[54] WIRELINE BLOWOUT PREVENTER

[76] Inventor: Arthur Ahlstone, 354 Agnus Dr., Ventura, Calif. 93003

[21] Appl. No.: 752,605

[22] Filed: Jul. 8, 1985

[51] Int. Cl.[4] ..... F16K 3/36

[52] U.S. Cl. ..... 137/246.22; 137/553; 251/1.3; 277/72 FM

[58] Field of Search ..... 251/1.3; 137/553, 246, 137/246.15, 246.16, 246.22; 166/82, 84, 88; 277/72 FM, 227

[56] References Cited

U.S. PATENT DOCUMENTS

| | | | |
|---|---|---|---|
| 577,147 | 2/1897 | Paul | 137/553 |
| 3,043,371 | 7/1962 | Rector | 166/88 |
| 3,291,490 | 12/1966 | Balmer | 277/72 FM |
| 4,214,605 | 7/1980 | Hardgrave | 251/1.3 |
| 4,227,543 | 10/1980 | Williams, Jr. | 251/1.3 |

*Primary Examiner*—Martin P. Schwadron
*Assistant Examiner*—Sheri M. Novack
*Attorney, Agent, or Firm*—Beehler, Pavitt, Siegemund, Jagger & Martella

[57] ABSTRACT

A ram-type blowout preventer having a removable seal insert contained in an insert cavity formed in the forward end of the ram body. Each seal insert includes an elastomeric body which forms an inner seal portion having a forward seal face and two outer seal portions which extend laterally into slot openings in the ram body. In each seal face is set a rigid cup which defines a cup-shaped cavity. When the rams are brought together to close the valve the two cups join together rim-to-rim to form a grease chamber between the seal forces.

29 Claims, 9 Drawing Figures

22
24
S
58
60
64
84
79
86
80
76
51
106
52
71
55
110
44
116
108
42
68b
F
70
69
61
62
50
R
68
73
72
68a
54

146
168
165
164
166
152
100
154
156
158
150
120
145
24
160
163
162
142
144

50
51
53
55
57
58
64
66
70
71
84
44
110
116
118
180
182
184

WIRELINE BLOWOUT PREVENTER

BACKGROUND OF THE INVENTION

1. Field of the Invention

The present invention pertains to the field of blowout preventer valves of the type used for sealing oil wells, and is more particularly directed to a wireline blowout preventer useful for sealing a well with a braided wireline extending through the preventer into the well.

2. State of the Prior Art

In general, existing blowout preventers have a valve body through which extends a vertical well bore with mounting flanges at each end for attachment to other well head apparatus. The valve body also includes a pair of aligned horizontal ram guides which intersect and open into the well bore at right angles thereto. Within each ram guide is a ram movable between an open, spaced apart position in which the rams are retracted into the ram guides and out of the well bore, and a closed position in which the rams are brought together into opposing engagement within the well bore to create a seal which closes the well bore. The movement of the rams between the open and closed positions may be accomplished by manual and/or hydraulic means.

Blowout preventers of the ram type have been in use since the 1920's. Early devices were blind ram blowout preventers used for sealing off wells without any piping or lines extending into the well. Later, blowout preventers were developed for sealing off well pressure with a pipe captive and extending through the blowout preventer into the well.

Wireline tools and operations came into increasing use during the middle of this century, and a need developed for wireline blowout preventers, i.e., blowout preventers capable of sealing the well with a wireline extending into the well. As working pressures at well heads became higher, and the use of braided wire became more common, the problem of creating an effective seal between the rams and the irregular surface of the braided wireline was addressed. Wireline operators found that by stacking two blowout preventers together, the bottom one upside down, and the top one right side up, an intermediate cavity was created between the top and bottom ram pairs into which a heavy grease could be injected. The grease would fill the voids and spaces between individual wires in the braided wire surface to provide a better seal between the braided wire and the blowout preventer rams. While this made it possible to seal higher well pressures, cleaning such a double blowout preventer following a sealing operation is a difficult and time-consuming task, due to the quantity of grease required to fill the relatively large cavity in the device and its tendency to gum-up the blowout preventer mechanism. Proper and safe maintenance of such devices remains a problem.

The dual ram-pair blowout preventers used in the past to seal high-pressure wells are too difficult to maintain and clean, and it is therefore desirable to provide a reliable single blowout preventer, i.e., one comprising a single pair of rams. Such single ram-pair wireline blowout preventers are known and commercially available from a number of manufactures of oil tooling.

Currently available single ram pair wireline blowout preventers typically depend on elastomeric seal inserts in the ram faces which are deformed by pressure against the braided wireline captive between the ram faces, such that the elastomer material tends to conform to and fill the crevices in the wireline surface. While such simple blowout preventers are adequate for relatively low well pressures, the seal formed between the elastomer and the wireline surface is not capable of withstanding higher pressures and heavier duty applications still require stacking of multiple single ram-pair units, with or without grease injected in-between to effectively seal off a well during wireline operations.

A somewhat improved single ram pair wireline blowout preventer is disclosed by Williams, Jr. in U.S. Pat. No. 4,227,543. In the Williams' device a plastic sealant material is injected through ports in the valve body opening into a cavity defined between the ram faces by grooves which extend across each of the ram faces in a direction perpendicular to both the ram guides and the well bore of the blowout preventer. The plastic sealant supplements the deformable seal inserts in the ram faces to make an improved seal against a pipe extending through the blowout preventer and captive between the rams. The Williams device requires that grease injection ports be provided in the valve housing in alignment with the grease conduit formed between the ram faces in the closed position, unnecessarily complicating the manufacture of the device. Williams requires a greater amount of "grease" packing material than the present invention, and also injects the grease into a channel extending diametrically across the well bore leading to more widespread contamination of the valve mechanism with grease than is necessary, thus increasing the difficulty and cost of maintenance of the same.

A continuing need therefore exists for a simple and effective wireline blowout preventer which is dependable at high well pressures, and yet which is easy to clean following a sealing operation and economical to maintain.

SUMMARY OF THE INVENTION

The improved wireline blowout preventer of this invention overcomes these and other shortcomings of the prior art, and comprises a valve body in which are defined a well bore and a pair of axially aligned ram guides opening into the well bore. A ram is movable within each ram guide between an open, mutually spaced-apart position and a closed position in which the rams are brought together to close off the well bore.

Each ram includes a ram body attached to a stem extending axially within each ram guide, and a removable seal insert contained in an insert cavity formed in the forward end of the ram body. Each seal insert includes an elastomer body which forms an inner seal portion having a forward seal face and two outer seal portions which extend laterally into slot openings in the ram body. In each seal face is set a rigid cup which defines a cup-shaped cavity. When the rams are brought together to close the valve the two cups join together rim-to-rim to form a grease chamber between the seal faces. Each cup has a forwardly oriented circular rim centered in the seal face and in which are formed two diametrically opposed notches conforming to the cross section of a particular wireline size to be captured between the rams in the closed position. The face of each seal insert further includes a wireline groove extending across the seal face in alignment with the notches in the rim of the cup. When the seal faces are joined together the grooves and the cup rim notches define a passage for accommodating a wireline captive between the rams and extending through the grease chamber. At least one of the rams is provided with a grease inlet which opens into its cup cavity and which communicates with a grease conduit extending axially through the stem attached to the corresponding ram. The grease conduit connects the cup cavity inlet with a grease injection port mounted on a portion of the ram stem which extends outside the valve body and is therefore accessible for injecting the grease through the stem conduit into the seal face cup cavity so as to pack the grease chamber with sealant material.

Each seal insert normally projects slightly from the forward end of the ram body such that the seal insert face leads the ram body. As the rams are brought together to close the valve, the opposing inner seal faces come into contact before the ram bodies engage each other, with the result that the seal inserts are compressed axially into their cavities in the respective ram bodies.

Each seal insert includes rigid extrusion guides which cooperates with portions of the rigid ram body to contain and direct the flow of elastomer material which occurs when the seal insert is axially compressed into the ram body. The elastomer is allowed to extrude outwardly through lateral slot openings in the ram body against the inner surface of the well bore so as to form part of the outer seal. The remainder of the outer seal is formed by an outer seal element carried by the ram body and set into a channel in the ram body surface, which channel communicates with the seal insert cavity. The compressed elastomer in the insert cavity is in contact with and extrudes against the elastomer of the outer seal element causing it to overflow its containing channel and bulge radially outwardly of the ram body into sealing contact with the ram guide wall. The forward edges of the extrusion guides and the cups in each seal insert oppose and urge each other rearwardly into the respective insert cavities and into the surrounding elastomer material. The cups sink into the resilient elastomer while the elastomer material bulges from the insert cavity forwardly about the rim of the rigid cup and towards the seal face of the opposing ram to form an inner seal between the rams and against a wireline captive between the seal faces. The inner seal also surrounds the joined cup rims so as to seal the grease chamber, leaving only minute passages between the inner seal faces and the irregular wireline surface. These minute passages are filled by grease seeping under pressure from the grease chamber along the wireline surface until a complete seal has been achieved.

The present wireline blowout preventer requires a much smaller amount of grease than prior art devices and furthermore the grease is confined to the cup cavities and a central area of the inner seal faces which are easily cleaned, and the grease does not flow into the ram guides where it can gum up the ram operating mechanism.

BRIEF DESCRIPTION OF THE DRAWINGS

FIG. 7 is a fragmentary cross sectional view of the blowout preventer valve taken in a horizontal plane showing the two rams in the closed position with a wireline captive there-between.

DETAILED DESCRIPTION OF THE PREFERRED EMBODIMENTS

Figure 1:
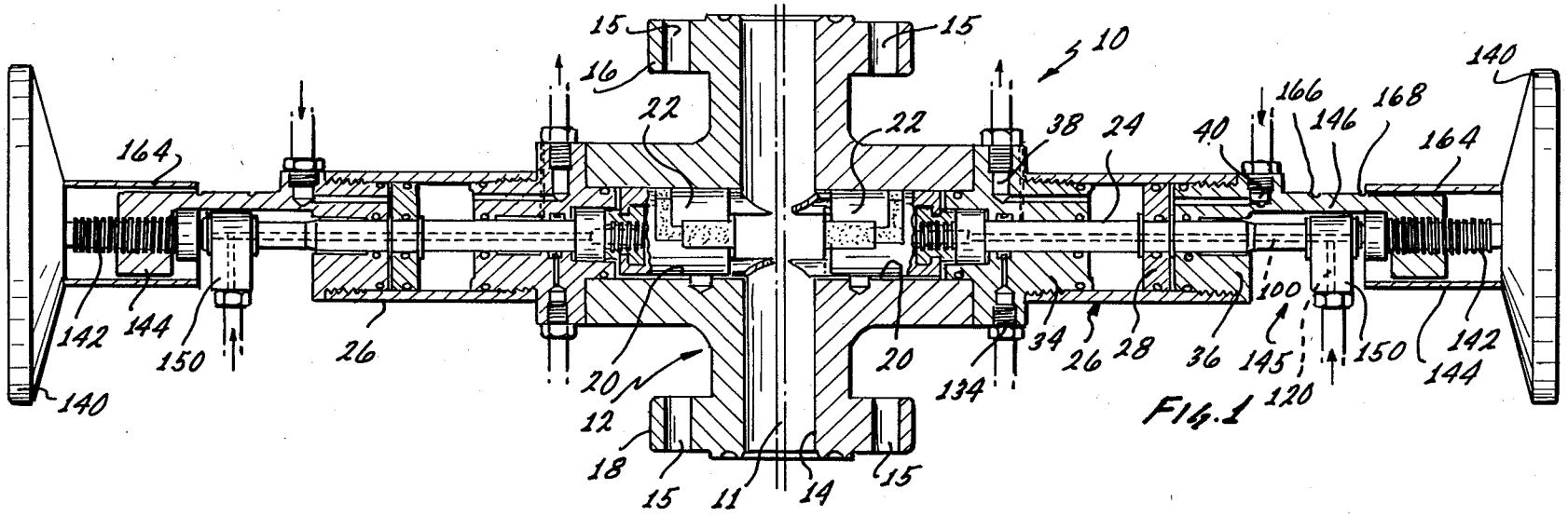
FIG. 1 is a cross-sectional view taken in elevation of the blowout preventer valve of this invention.

With reference to the drawings, and FIG. 1 in particular, the novel wireline blowout preventer valve 10 includes a valve body 12 in which is defined a vertical well bore 14 extending between an upper connector flange 16 and a lower connector flange 18. Each of the connector flanges has bolt holes 15 for attaching the valve 10 to other well head equipment.

Figure 7:
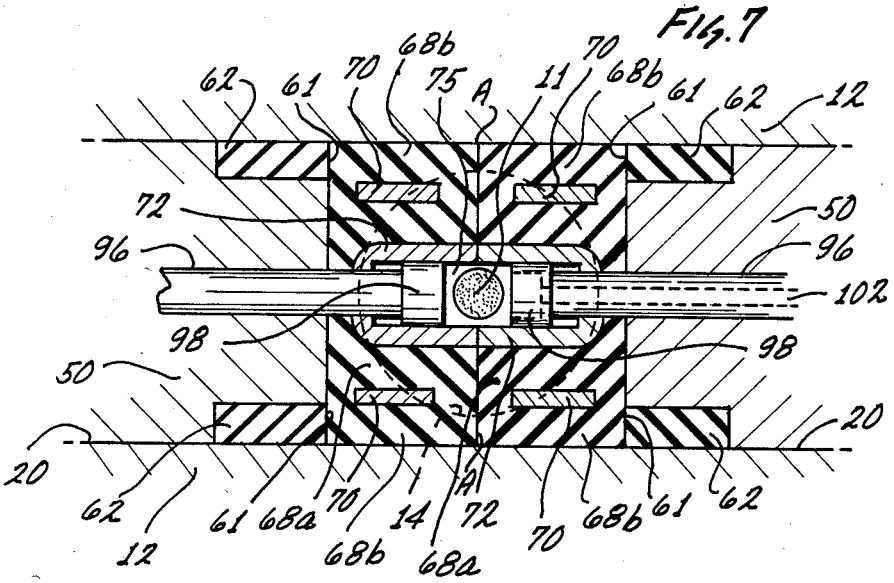

The valve body 12 also defines a pair of horizontal ram guide bores 20 which are axially aligned with each other, and intersect at right angles the well bore 14. Within each ram guide is a ram 22 movable between an open, spaced-apart position shown in FIG. 1, wherein the rams are retracted from the well bore into the ram guides to thereby allow fluid flow through the well bore 14, and a closed position in which the rams are brought together into sealing engagement within the well bore as illustrated in FIG. 7, thereby closing flow through the well bore 14.

Figure 2:
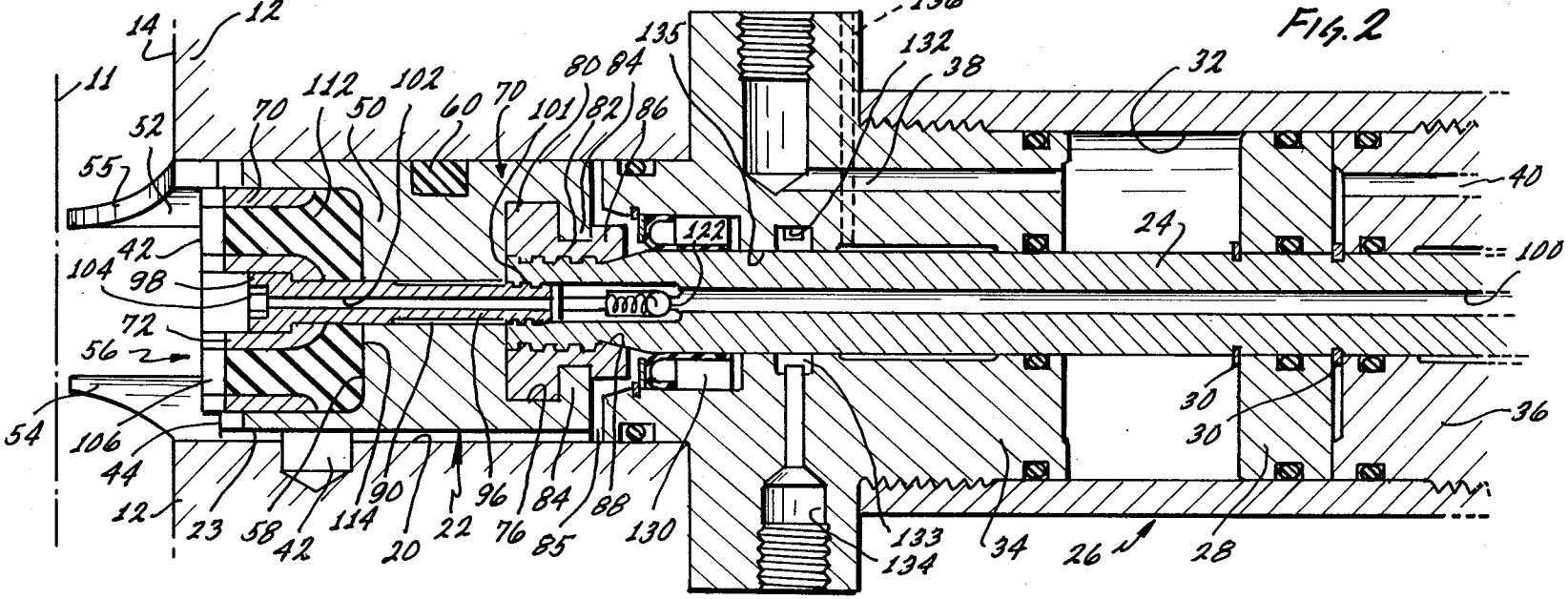
FIG. 2 is a fragmentary cross-sectional view of the valve of FIG. 1 enlarged to better show one of the rams and its corresponding hydraulic operating mechanism.

Each ram 22 is movable between the open and closed positions by means of a hydraulic actuator 26, best seen in FIG. 2. Each actuator 26 includes an axial ram stem 24 connected at its inner end to the rear of the ram 22. A piston 28 is fixed to the stem 24 by means of a pair of snap rings 30 keyed to the stem 24. The piston 28 is reciprocable within an actuator cylinder 32 between an actuator body 34 and an end cap 36. The actuator body is attached to the valve body 12 in a conventional manner by means of mounting bolts (not shown). The actuator cylinder 32 is internally threaded at both ends, one end threading onto the actuator body 34, the opposite end of the actuator cylinder accepting a threaded portion of the end cap 36. A first hydraulic port 38 is provided in the actuator body while a second hydraulic port 40 is provided in the end cap 36, both hydraulic ports communicating with the interior of the cylinder 32 but on opposite sides of the piston 28. The ram 22 is moved by applying a hydraulic pressure differential across the piston 28. Thus, if positive hydraulic pressure is applied to port 38 relative to port 40, the piston 28 and stem 24 move towards the end cap, withdrawing the attached ram 22 from the well bore to thereby open the valve. By reversing hydraulic pressure between the ports 38, 40, positive pressure can be applied to the other side of the piston 28, to urge the piston and stem towards the actuator body 34, thus moving the rams 22 into sealing engagement in the well bore, thereby closing the valve.

Figure 3:
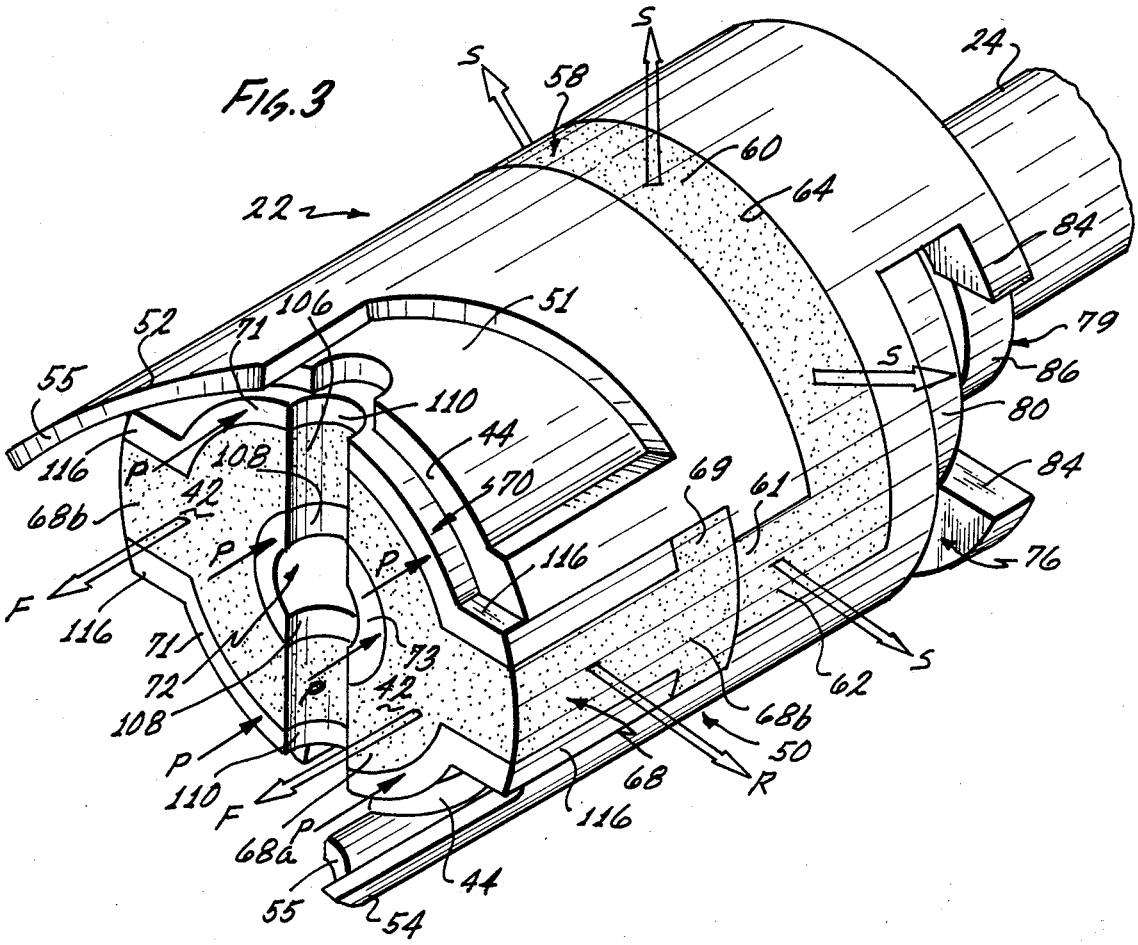
FIG. 3 is a perspective view of a ram attached to its stem.
Figure 4:
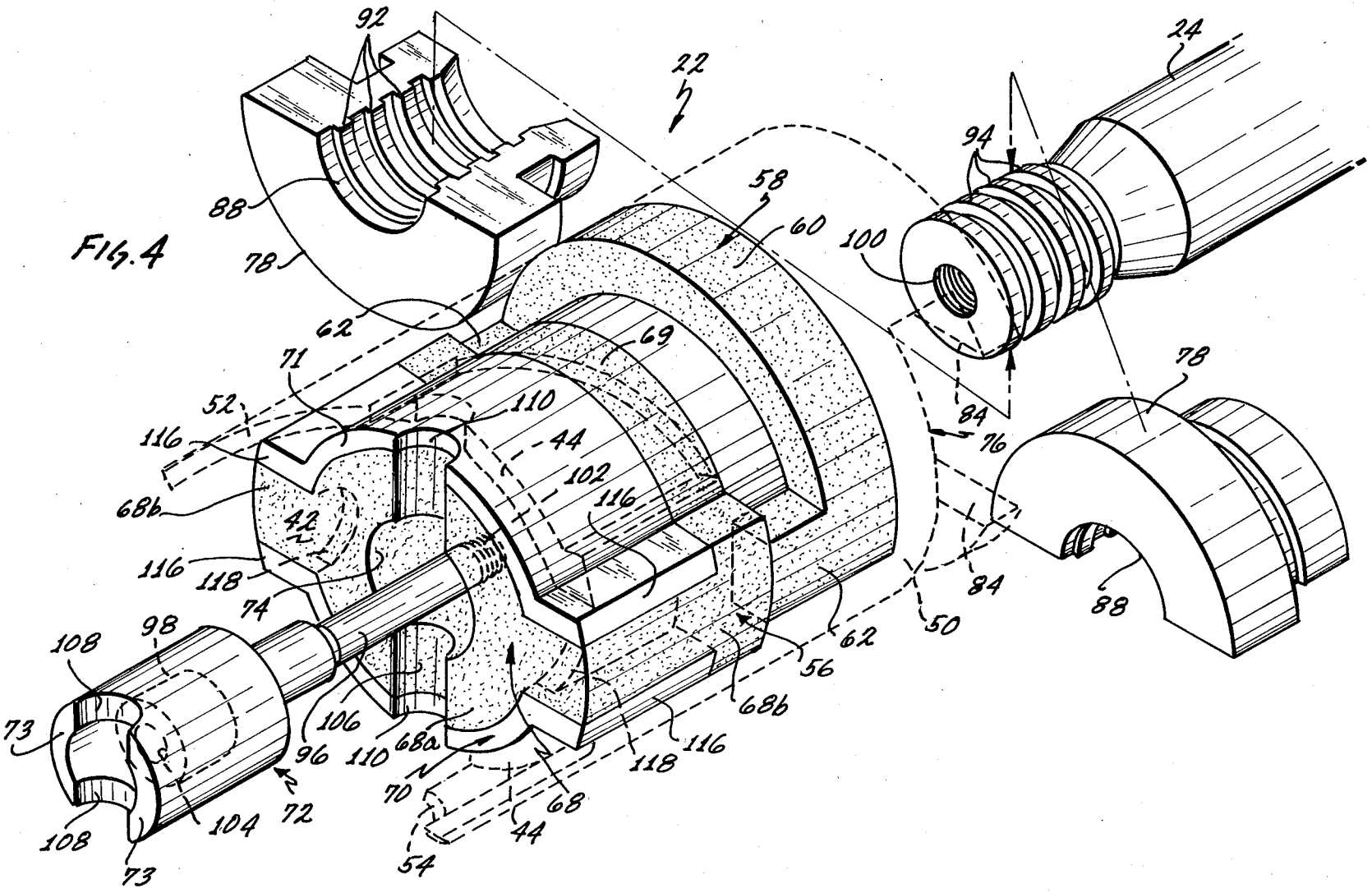
FIG. 4 illustrates the mounting of the seal insert and the outer seal element to a ram body drawn in phantom lining and with the cup, the cup retaining bolt, and stem connector assembly shown exploded from the ram.
Figures 5, 8:
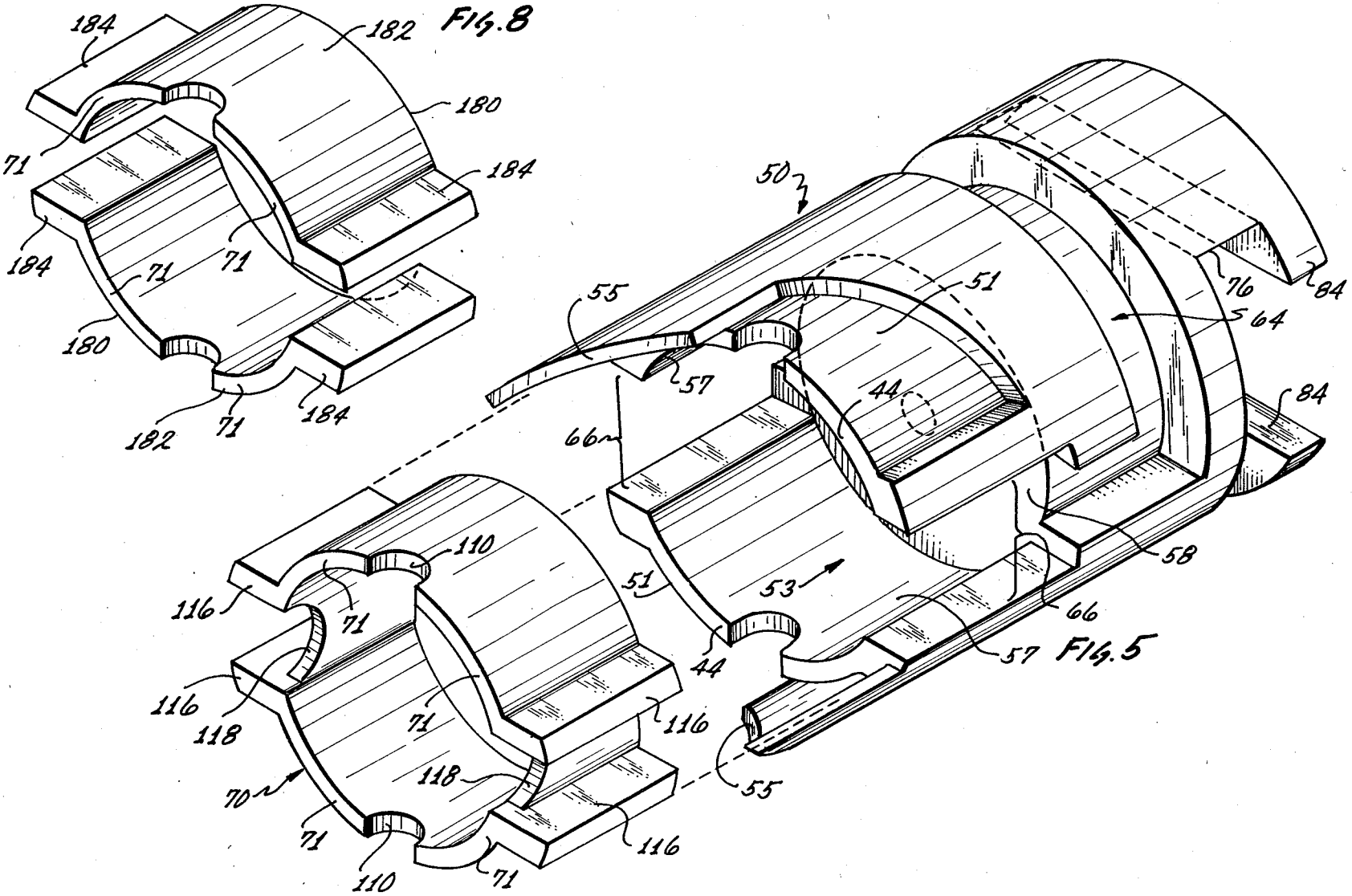
FIG. 5 shows a ram body and a seal insert extrusion guide in exploded perspective and free of all elastomer material.
FIG. 8 is a perspective view of an alternate extrusion guide structure for the elastomeric seal insert.
Figure 6:
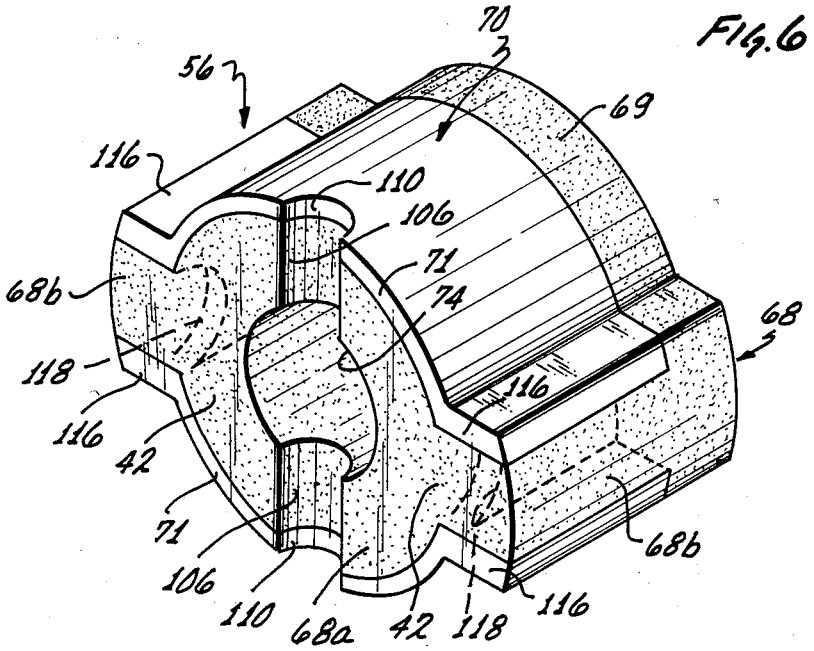
FIG. 6 is a perspective view of a seal insert with the cup removed.

Each ram 22 consists of a generally cylindrical ram body 50, best seen in FIG. 5, and a removable seal insert 56 shown in FIG. 6 and mounted within an insert cavity 58 formed in the ram body as best understood by reference to FIGS. 3 and 4. Each ram body has one upper wireline guide 52 and one lower wireline guide 54 of generally triangular configuration. The wireline guides of each ram body mate into recessed areas 51 in the opposite ram body in a conventional manner. As the opposing rams 22 approach each other during closure of the valve, the forward edges 55 of the four ram guides cooperate to center a wireline 11 extending through the well bore 14 into alignment with wireline grooves 106 extending diametrically across each ram face 42 as best seen in FIG. 3.

A cylindrical insert cavity 53 is formed in the front of the ram body 50 which is bounded by a bottom wall 58 and a cavity side wall 57. The insert cavity opens to the front of the ram body and also laterally through slot opening 66 extending in an axial direction at diametrically opposed locations in the insert cavity side wall, as best understood by reference to FIG. 5.

Each ram body 50 is fitted with an outer elastomeric seal element 58, best seen in FIG. 4, which comprises two mutually parallel lateral portions 62 extending in an axial direction and interconnected at their rear ends by a semicircular radial portion 60. The outer seal element 58 is recessed into a saddle-shaped outer seal slot 64 defined in the ram body 50 which contains the outer seal 58 against expansion except radially outwardly from the ram body. As best seen in FIG. 5, the forward ends of the outer seal slot 64 communicate with the rear ends of the lateral slots 66 on each side of the central cylindrical insert cavity 53.

The seal insert 56, as shown in FIGS. 3, 4 and 6, includes a unitary elastomer body 68 formed about an extrusion guide ring 70, and a grease cup 72 set into a cavity 74 axially centered in the face 42 of the elastomer body 68. The elastomer body 68 has a cylindrical central portion 68*a* which fits into the insert cavity 53 of the ram body and two lateral outer seal portions 68*b* which slide into the slots 66 of the ram body. The extrusion guide 70, the grease cup 72, and the ram body 50 are all made of a hard, rigid material such as steel.

The rear end of the ram body has defined therein a diametrically extending keyway 76, best seen in FIG. 5, into which is slidable a stem retainer 79 consisting of two pieces 78 shown in FIG. 4. Each of the two pieces 78 are generally semicylindrical and are assembled as best understood from FIGS. 2, 3 and 4 to form a cylindrical assembly 79 shaped to define an enlarged inner ring 80 which slides radially into the keyway 76 and holds the retainer 79 against axial separation from the ram body 50, a narrower waist 82 which fits into the slot opening defined between keyway flanges 84, and an outer ring 86, which fits externally against the rear end of the ram body 50. When assembled, the stem retainer 79 has an axial bore 88 provided with a number of internal axially spaced circumferential flanges which define circumferential grooves 92 therebetween. The inner end of the ram stem 24 is provided with a series of axially spaced circular male flanges 94 which fit into and interlock with the grooves 92 in the stem retainer 79. Each ram 22 is attached to its corresponding stem 24 by first assembling the two stem retainer pieces 78 onto the flanged inner end of the stem, and then sliding the cylindrical stem retainer assembly 79 radially inwardly into the keyway 76 of the ram body 50. The keyway prevents separation of the two stem retainer pieces 78, while axial alignment of the stem with the ram body is maintained by a cup retainer bolt 96 which extends through a hole in the bottom of cup 72, a bore in elastomer seal 68, and an axial bore 90 in the ram body 50. The retainer bolt 96 has an enlarged head 98 captive within the cup 72, and is threaded at its opposite end 101 into the flanged end of stem 24.

Turning to FIG. 2, a grease injection conduit 100 is defined coaxially within the stem 24, and communicates with an axial duct 102 extending through the cup retainer bolt 96 connecting the conduit 100 to a grease inlet 104 formed in the bolt head 98 and opening into the interior of cup 72. The grease inlet 104 may take the form of a hexagonal socket 104 shaped and sized for receiving a mating hexagonal wrench for unscrewing the bolt 96 from the stem 24, thereby to allow removal of the seal insert 56 from the ram body 50 and also permit disengagement of the ram body from the stem 24.

With reference to FIGS. 3 and 4, a wireline groove 106 of semicircular cross section extends diametrically across the seal insert face 42 in perpendicular relationship to the inner seal slot 66 in the ram body and in alignment with diametrically opposed semicircular notches 108 in the rim 73 of the cup insert 72, and also in alignment with diametrically opposed semicircular notches 110 in the forward edge of the retainer ring 70. When the valve 10 is closed the wireline grooves 106 defined in the opposing ram faces together define a cylindrical passage for a wireline 11 captive between the rams 22 and passing through a grease chamber 75 defined between the joined cup inserts 72 as shown in FIG. 7.

As best understood by reference to FIGS. 3 and 4, the axial dimension of the seal insert 56 is somewhat greater than the depth of the insert cavity 53, such that a small forward portion of the seal insert 56 protrudes out of the ram body and the face 42 of the seal insert lies forwardly of and leads the forward edges 44 of the ram body.

As shown in FIG. 6, each seal insert 56 includes an elastomeric seal element 68 which has a central cylindrical seal portion 68*a* disposed within the insert cavity coaxially with the ram body and stem 24, and a pair of diametrically opposed, laterally extending outer seal portions 68*b*. The seal insert 56 further includes a rigid extrusion guide ring 70 which encompasses and contains the cylindrical portion 68*a* of the seal insert. Two pairs of parallel spaced-apart extrusion guide plates 116 extend laterally from the ring 70 at diametrically opposed points.

The forward edge of the ring 70 is flush with the inner seal face 42, but the ring 70 is shorter in its axial dimension than the axial dimension of the elastomer body 68 of the seal insert 56, such that the rear portion 69 of the elastomer body 68 is not contained by the ring and thereby allowing the ring 70 to move into the insert cavity when pressure is applied to its forward edges. Each lateral outer seal portion 68*b* is contained between one pair of plates 116, and is also integrally connected with the central portion 68*a*, both at the front of the seal insert through semi-circular cutouts 118 formed in the front edge of the ring 70 between each pair of plates 116, and also behind the rear edge of the ring 70. The structure of the ring 70 is best understood by reference to FIG. 5 where the elastomer elements of both the seal insert and the ram body have been omitted for clarity of illustration. The elastomer body 68 which comprises both the inner and outer seal portions 68*a* and 68*b* respectively of the seal insert may be molded as a unitary mass onto the ring 70, so as to embed portions of the ring in the elastomer mass.

As shown in FIG. 3, and with reference to FIGS. 2 and 5, when the seal insert 56 is assembled to the ram body 50, the planar rear surface 114 of the elastomer body 68 lies against the unyielding bottom wall 58 of the insert cavity 53 in the ram body. The radially outer surfaces of the lateral outer seal portions **68*b* are cylindrically curved and flush with the outer cylindrical surface of the ram body, while the back surfaces of the outer seal portions 68*b* abut with the front end surfaces 61 of the lateral portions 62 of the outer seal element 58 mounted to the ram body behind the seal insert, as best understood by reference to FIG. 7**.

Upon closing the valve, the forward ends of the two rams 22 are urged into mutually opposing relationship within the well bore 14 capturing the wireline 11 within the vertical cylindrical conduit defined between the two wireline grooves 106 extending across each of the joined ram faces. The two seal inserts 56 oppose each other face to face, and are thus each urged axially into their respective insert cavities 53 in the ram bodies 50. The front edges 73 of the two cups 72 oppose each other during engagement of the rams, and are each urged rearwardly into the elastomer **68*a* by sliding along the smooth shank of the insert retainer bolt 96. Likewise, the front edges 71 of the retaining rings 70 oppose each other, urging the retaining rings rearwardly into their respective insert cavity 53 against the elastomer material 68 filling the insert cavity. The combined inward movement of the cup 72 and ring 70 suggested by arrows P in FIG. 3 displaces elastomer material from the interior of the seal insert cavities 53, causing each of the seal insert faces 42 to bulge outwardly, as suggested by arrows F, against the face 42 of the opposing seal insert to form an inner seal between the ram faces surrounding the joined forward rims 73 of the two grease cups 72, and also against the surface of wireline 11 captive therebetween as best understood by reference to FIG. 7. This inner seal involves the front surfaces of the central and outer seal portions 68*a* and 68*b*, respectively, such that the inner seal extends between the two ram faces horizontally and fully diametrically across the vertical well bore 14 along line A—A in FIG. 7**.

At the same time, the elastomer of the central portion **68*a* of the seal insert expands radially under axial compression and flows outwardly around the frontal semicircular notches 118 of the retaining ring 70, and also radially outwardly behind the retaining ring, into the lateral spaces defined between the two pairs of plates 116. As a result of this influx of material, the outer seal portions 68*b* bulge radially outwardly of the ram body as indicated by arrow R in FIG. 3, and make sealing contact with the inner surface of ram guides 20 at the intersection of the ram guide bore 20 with the vertical well bore 14. The outer seal elements 68*b* also expand rearwardly against the forward ends 61 of the outer seal element 58 and into the channel 64 containing the outer seal element 58 which thus overflows its groove 64 in the ram body and bulges radially from the ram body along its entire length, as indicated by arrows S, into sealing engagement with the interior cylindrical surface of its corresponding ram guide 20. Arrows R and S together indicate the outer seal created upon closure of the valve which extends along the semicircular portions 60 of the two seals 58 and horizontally along the horizontal seal portions 62 and 68*b* of each of the two joined rams 22, as better understood by reference to FIG. 7, the inner and outer seals together sealing the well bore 14**.

The wireline seal is completed by injecting a grease packing into the grease chamber 75 formed between the joined cups 72 as shown in FIG. 7. The semicircular notches 108 in the joined cup inserts 72 define two circular openings closely conforming to the cross-section of the wireline 11 extending through the grease chamber 75. The grease is injected through external port 120 into the axial grease conduit 100 extending through the stem 24 and is forced under pressure through check valve 122 as best understood from FIGS. 2 and 9. The grease then flows through the axial conduit 102 and inlet port 104 in the insert retaining bolt 90 and into the grease chamber. Such grease injection conduits may be provided in one or both of the ram stems 24 in valve 10. The seal between the notched cup edges and the wireline surface is imperfect due to the interstitial spaces defined between the individual wires which make up the braided wireline and give it an irregular cylindrical surface. The grease packing under pressure fills the crevices and spaces which remain between the irregular wireline surface and the smooth edges of the semicircular notches 108 in the rims of the cups 72, and flows out of the grease chamber through these spaces upwardly and downwardly along the wireline surface, filling any voids remaining in the vicinity of the cups 72 between the wireline surface and the elastomer surface within the grooves 106 of the seal faces, until a sufficient seal has been formed which will prevent additional grease packing from escaping out of the cups 72. Typically, only a small amount of grease escapes from the grease chamber 75 before good seal is formed and the escaping grease does not flow beyond the seal face surfaces.

Turning to FIG. 2, each ram 22 is held against rotation within its ram guide 20 by a ram key 42 which is fixed to the valve body 12 and projects into a key slot 23 defined in each ram body 50. This key slot 23 extends the full axial length of the ram body so as to provide a passage for equalizing pressure between the vertical well bore 14 and the space 85 in the ram guide 22 behind the ram 22, allowing the well pressure to act against the rear of the rams.

The interior space 85 in the ram guides 20 behind each of the rams 22 remains in communication with the lower end of the well bore through the slot 23 in each ram body 50 after the blowout preventer valve is closed such that once the rams are brought together they are urged into and maintained in sealing engagement by the differential between well pressure at the lower end of the blowout preventer and atmospheric pressure at the upper end of the valve. In order to open the valve, enough force must be applied to move apart the rams sufficiently to break the seal, and thereby equalize pressure between the front and rear of each ram, after which the rams are easily retracted into their respective ram guides.

Each ram stem 24 passes through a dynamic seal 130 such as a Teflon O-ring seal which closes the rear of the ram guide 22 against leakage at well pressure through the stem bore 135. An auxiliary ram guide seal comprises a Teflon seal ring 133 about each stem 24 in a radial groove 132 defined in the actuator body 34 rearwardly of the dynamic seal 130. In the event of failure of the seal 130, a plastic packing may be injected through port 134 into the radial groove 132 so as to force the Teflon seal ring 133 tightly against the stem 24, and thereby prevent leakage through the stem bore 135 in the actuator body 34. Failure of the seal 130 may be visually detected by leakage of material through a tattletale port 136 extending radially through the actuator body 34 and communicating with the stem bore 135. Provision of such a tattletale port is optional.

Figure 9:
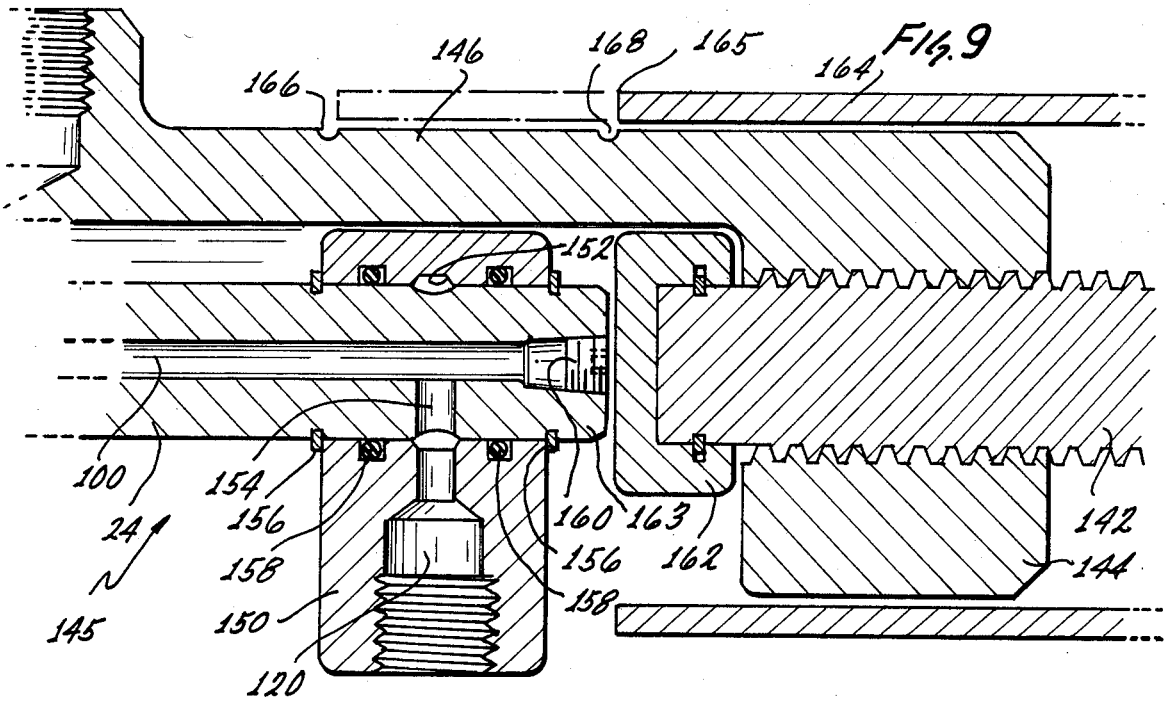
FIG. 9 is a partial cross-sectional view showing the grease injection port at the outer end of the ram stem and the visual valve status indicator.

Turning now to FIG. 1, each of the hydraulic ram actuators 26 is supplemented by a manual valve closing mechanism which includes a handle 140 mounted to one end of a handle screw 142 threaded through the outer end 144 of the end cap 36 in axial alignment with the ram stem 24. The end portion 144 is connected to the main cap body 36 by a bridge section 146, which extends generally parallel to but is axially offset from the stem 24 so as to define an open gap 145 between the end cap 36 and end block 144. The outer end 163 of the stem 24 extends from the end cap 36 into this gap, as best seen in FIG. 9. A connector block 150 is mounted onto the stem 24 within the gap 145 and is freely rotatable about the stem. An external grease injection port 120 communicates with a radial groove 152 in the connector block 150. The groove 152 is aligned with a radial inlet 154 in the stem 24 which inlet in turn opens into the axial grease duct 100. The coupling 150 is axially fixed in place on the stem 24 by means of snap rings 156 and a ring seal 158 is provided on each side of the annular groove 152 so as to prevent seepage of grease through the stem bore in the coupler block.

The axial grease conduit 100 extends to the outer end 163 of the stem, and is closed by a threaded plug 160 which is removable from the stem to permit easy cleaning of the axial conduit 100. The grease duct 100, check valve 122, and duct 102 in the insert remaining bolt 96 can all be conveniently cleaned by injecting a suitable solvent through the grease injection port 120.

The handle screw 142 is provided with a cap 162 which is freely rotatable on the inner end of the handle screw 142 so as not to transfer rotation of the screw to the stem 24 while inward force for closing the valve is being applied to the stem through the screw 142 by manual rotation of the handle 140.

The handle 140 is further provided with a cylindrical handle sleeve 164 which covers and protects the screw 142 and receives into its open end 165 part of the bridge portion 146 of the end block 144. Markings 166 and 168 may be applied to the bridge portion 146 indicative respectively of a closed and an open position of the blowout preventer valve. For example, a "closed" notch 166 and an "open" notch 168 may be inscribed in axially spaced relationship on the bridge portion 146 and disposed such that the inner edge 165 of the handle sleeve 164 is aligned with the "open" notch 168 when the valve is open (as shown in solid lining in FIG. 9), but covers the "open" marking and is aligned with the "closed" mark 166 when the blowout preventer is manually closed (as indicated in dotted lining in the same figure). This visual valve status indicator helps to prevent an attempt to hydraulically open the valve while the handle screw 142 is threaded fully into the end block 144 and thus prevents retraction of the stem 24. Such an attempt is likely to damage the valve and/or the hydraulic actuating system. The manual system only serves to close the valve. The valve must be opened by hydraulic means since manual force cannot normally overcome the well pressure.

FIG. 8 illustrates an alternate form of the rigid extrusion guide for the seal insert 56 comprising two separate pieces 180, each having a cylindrically curved portion 182 intermediate a pair of co-planar lateral anti-extrusion plates 184. The two pieces 180 are embedded and held in the spaced apart relationship shown in FIG. 8 in the elastomer body 68 of the seal insert molded onto the pieces 180. The two pieces 180 are equivalent to the one-piece ring 70 of FIGS. 3–5, but with the notched ring portions between the parallel pairs of plates 116 removed.

While a particular embodiment of the invention has been shown and illustrated for purposes of clarity, it will be understood that many changes, modifications and substitutions will be obvious to those possessed of average skill in the art. Therefore, the scope of the invention is to be limited only by the following claims.

What is claimed is:

1. A wireline blowout preventer comprising:

a valve body, a well bore extending through said valve body, a pair of axially aligned ram guides in said valve body intersecting said well bore, a ram in each said ram guide, means for moving said rams between an open spaced-apart position in which said rams are retracted into said ram guides and a closed position in which the rams are moved into the well bore for closing said well bore, each said ram including a ram body, an axial stem attached to said ram body and a seal insert removably mounted to said ram body, each seal insert having elastomeric seal means defining a forward seal face, a rigid cup set into said seal face and defining a cup cavity, said cups joining to define a chamber between said rams in said closed position, conduit means extending axially through one or both of said ram bodies and its corresponding stem and seal insert and opening into said cup for injecting a packing material into said chamber, said elastomeric seal means being compressed axially in said closed position, and extrusion guide means for directing flow of the compressed elastomer for making an inner seal surrounding said joined cups to seal said chamber.

2. The blowout preventer valve of claim 1 wherein each said cup is movable rearwardly against said elastomeric seal means relative to said ram body for extruding elastomer material in response to force mutually exerted by said cups on each other in said closed position, and further comprising extrusion guide means for directing extrusion of the elastomer material forwardly about said cup such that the seal faces of the two rams bulge towards each other to form said inner seal in said closed position of the valve.

3. The blowout preventer of claim 2 further comprising at least one grease injection port on said axial stem accessible exteriorly to said valve body for injecting packing material through said conduit means into said cup cavity.

4. The blowout preventer of claim 2 wherein each said cup has a notched forward rim and a bottom, the notches of the joined cups together defining wireline openings in said chamber conforming to the cross section of a wireline to be captured between said rams with the wireline extending through said chamber.

5. The blowout preventer of claim 4 wherein a wireline groove of semi-cylindrical cross-section extends diametrically across each seal face in alignment with said notches in the cup rim, said grooves together defining in said closed position a cylindrical passage for a wireline extending through said chamber and captive between the rams.

6. The blowout preventer of claim 5 wherein each said ram body further comprises guide means for aligning a wireline extending through said well bore with said wireline grooves and into said cylindrical passage as said rams are moved from said open to said closed position.

7. The blowout preventer of claim 4 wherein each said cup rim is substantially flush with said inner seal face, and further comprising an insert retaining bolt extending through an opening in the bottom of said cup and through aligned axial bores in said seal insert and said ram body, said retainer bolt having an enlarged head captive within said cup and being threadable at its opposite end to said stem for retaining the seal insert to the ram body and the ram body to said stem, said conduit means including a bolt conduit extending through said retainer bolt and an inlet opening formed in said bolt head such that packing material may be injected into said cup through said retainer bolt.

8. The blowout preventer of claim 3 wherein said exteriorly accessible injection port comprises a coupling block freely rotatable in axially fixed relationship about said axial stem, a radial groove in said block and about said stem, a port defined in said block and communicating with said radial groove, a radial inlet communicating said stem conduit with said radial groove, and seal means between said block and said stem on either side of said radial groove for preventing leakage of sealant material injected into said stem conduit through said injection port.

9. The blowout preventer of claim 8 wherein each said axial stem extends through an end cap attached to said valve body, each said end cap having a main cap body and an end block with a gap therebetween into which gap extends the outer end of the axial stem, said connector block being mounted to said stem within said gap.

10. The blowout preventer of claim 9 further comprising manual valve closing means including a handle screw threaded through said end block of the end cap, a handle for turning said handle screw, indicia on said end cap indicative respectively of a closed and an open position of said screw, and indicator means attached for movement with said handle during axial displacement of said screw relative to said end cap, said indicator means aligning with the appropriate indicia to indicate the status of the manual closing means.

11. The blowout preventer of claim 10 wherein said indicia are axially spaced marks on said end cap and said indicator means is a sleeve affixed to said handle and extending over said end cap, said sleeve aligning with the appropriate mark to indicate the status of the manual closure means.

12. The blowout preventer of claim 1 further comprising check valve means in said conduit means for containing pressurized packing material in said chamber against return flow through said conduit means.

13. A ram for a blowout preventer valve comprising:

a ram body having a forward end and a rear end, an insert cavity defined in said forward end, an elastomeric outer seal element set in a seal groove defined in said ram body, said outer seal element including a radial semi-cylindrical seal portion interconnecting a first pair of lateral outer seal portions;

a seal insert removably disposed in said insert cavity and having a forward seal face, a portion of said seal insert extending from said insert cavity such that said seal face is disposed forwardly of the forward end of said ram body, said seal insert comprising an elastomer body including a generally cylindrical central portion and a second pair of lateral outer seal portions extending in diametrically opposed relationship from said central portion, a rigid cup set axially into said central elastomer body and defining a cup cavity centered in said seal face, a wireline groove extending diametrically across said seal face, an insert retaining bolt extending axially through said cup, said seal insert and said ram body; conduit means defined in said retaining bolt for injecting a sealant substance into said cup cavity, and extrusion guide means for directing elastomer extrusion resulting from axial compression of said elastomer body into said insert cavity forward from said seal face to thereby make an inner seal between opposing ram faces and radially outwardly from said second pair of lateral outer seal portions to thereby make an outer seal with the inner surface of a ram guide containing said ram.

14. The ram of claim 13 wherein said insert cavity comprises a central cylindrical cavity surrounded by a cavity wall and diametrically opposed lateral slots extending in an axial direction in said cavity wall from the forward end of the ram body, said second pair of lateral outer seal portions fitting into said lateral slots, said central elastomer body fitting into said central cylindrical cavity.

15. The ram of claim 14 wherein said central cylindrical cavity terminates in a bottom wall and the forward ends of each said first lateral outer seal portion is in abutment with the rear of one of said second lateral outer seal portions, said extrusion guide means also directing flow of elastomer from said second outer seal portions into said groove containing said first outer seal portions to cause said outer seal element to overflow said groove radially outwardly from said ram body into sealing contact with the valve body.

16. The ram of claim 13 wherein said retaining bolt is threaded at its rear end for attachment to a ram stem.

17. The ram of claim 13 wherein said ram body includes guides for aligning a wireline extending through said well bore with said wireline groove.

18. The ram of claim 13 wherein said cup insert has a circular forward rim and a pair of diametrically opposed semi-circular notches in said rim aligned with said wireline groove and dimensioned to conform to the cross-section of the particular wireline to be sealed between a pair of such rams.

19. The ram of claim 13 wherein said retaining bolt includes a bolt head within said cup cavity, said bolt conduit opening axially at said bolt head into said cup cavity.

20. The ram of claim 19 wherein said bolt conduit opens into a socket defined in said bolt head, said socket being adapted to receive a wrench tool for removing said bolt.

21. The ram of claim 13 wherein said retaining bolt has a smooth shank portion and said cup is slidable along said smooth shank portion against said central elastomer body and into said insert cavity so as to displace elastomer material from said insert cavity.

22. The ram of claim 13 further comprising a diametric keyway defined in the rear end of said ram body adapted to receive a stem retainer assembly for interconnecting said ram body to a ram stem.

23. The ram of claim 22 further comprising a ram stem including an axial conduit defined in said stem, a stem retainer assembly adapted to interconnect the ram to the stem, the rear end of said retainer bolt being threadable into the stem with the bolt conduit in communication with said stem conduit.

24. The ram of claim 13 wherein said extrusion guide means comprise a rigid ring encompassing said central cylindrical elastomer portion and two pairs of parallel spaced apart extrusion plates extending outwardly from said ring, each of said second lateral outer seal portions being contained between one of said extrusion plate pairs, said ring and said extrusion plates having front edges and rear edges, said front edges being flush with said seal insert face, said elastomer body extending beyond said rear edges such that said extrusion guide means is spaced from the bottom of said insert cavity and is movable into said cavity in response to inward force applied to said front edges, said central elastomer body being integrally connected with said second outer seal portions rearwardly of said ring, said forward edge of the ring being notched intermediate each said pair of extrusion plates, said second outer seal portions merging with said central elastomer body at said ring notches.

25. The ram of claim 13 further comprising diametrically opposed notches in the forward end of said ram body aligned with said wireline groove in said seal insert face for receiving a wireline upon axial compression of the seal insert into said insert cavity.

26. The ram of claim 13 wherein said extrusion guide means comprise two extrusion plates, each plate having a central circularly arcuate portion connecting two coplanar lateral plates, said extrusion plates being embedded in the elastomer of said seal insert such that said end plates are in spaced parallel relationship and said arcuate portions define a cylinder open between said spaced parallel plates for directing extrusion of the central elastomer body diametrically outwardly, each of said extrusion plates having a front edge flush with the front face of the seal, the axial dimension of said extrusion plates being lesser than the axial dimension of the seal insert so as to allow the extrusion plates to be displaced into the insert cavity and against said elastomer body in response to inward force appplied to said front edges.

27. A ram for use in a blowout preventer valve of the type having a valve body, a well bore and a pair of ram guides defined in said well bore and means for moving a ram in each of said ram guides between an open spaced-apart position and a closed position in which the rams are urged into opposing engagement within the well bore, the ram comprising:

a generally cylindrical ram body, elastomeric seal means including a forward inner seal face and outer seal means mounted to said ram body, a rigid cup set into said seal face and movable rearwardly against said elastomeric seal means, extrusion guide means for directing elastomer extrusion in response to inward force on said seal face and said cup during opposing engagement of the rams such that the forward seal face forms a circular inner seal about said cup and said outer seal means form an outer seal with the inner surfaces of said ram guides to seal said well bore with a wireline extending through the well bore and captive between said seal faces, said cups joining to form a grease chamber about said wireline, and conduit means for introducing a packing material into said chamber.

28. The ram of claim 27 further comprising an insert cavity defined in said ram body and a seal insert removably disposed in said cavity, said insert including said seal face and a portion of said outer seal means, the remainder of said outer seal means being set into said ram body, and a retainer bolt extending axially through said insert and ram body, said conduit means including a bolt conduit extending through said bolt and opening within said cup.

29. The ram of claim 27 wherein said seal insert has a cylindrical center portion axially aligned with said ram body and said cup has a circular forward rim concentric with said cylindrical center portion.

* * * * *